US006035879A

United States Patent [19]

Campbell et al.

[11] Patent Number: 6,035,879

[45] Date of Patent: Mar. 14, 2000

[54] AUTOMATIC FILL VALVE ASSEMBLY

[75] Inventors: Sanford F. Campbell; Robert E. Jones; James P. Ellis, all of Redding, Calif.

[73] Assignee: Letro Products, Inc., Redding, Calif.

[21] Appl. No.: 08/754,815

[22] Filed: Nov. 21, 1996

[51] Int. Cl.[7] ..... F16K 43/00; F16K 31/24; F16K 33/00

[52] U.S. Cl. ..... 137/15; 4/508; 137/315; 137/428; 137/432; 137/444; 405/80

[58] Field of Search ..... 137/428, 15, 315, 137/414, 432, 443, 444, 434; 4/508, 509, 507; 405/80, 96

[56] References Cited

U.S. PATENT DOCUMENTS

| | | | |
|---|---|---|---|
| 2,809,752 | 10/1957 | Leslie | 137/428 |
| 3,739,405 | 6/1973 | Schmidt | 137/428 |
| 3,908,206 | 9/1975 | Grewing | 137/428 |
| 4,373,220 | 2/1983 | Selsted | 137/428 |
| 4,574,405 | 3/1986 | Tams | 137/428 |
| 4,686,718 | 8/1987 | Kinkhead et al. | 137/428 |
| 4,735,230 | 4/1988 | Detloff | 137/428 |
| 4,972,530 | 11/1990 | Synder | 4/508 |
| 5,154,205 | 10/1992 | Langill | 4/508 |
| 5,365,617 | 11/1994 | Tarr | 137/428 |
| 5,367,723 | 11/1994 | Pleva et al. | 137/428 |

OTHER PUBLICATIONS

"Automatic Water Leveler 1953–J," MP Industries, Garden Grove, California.

*Primary Examiner*—George L. Walton
*Attorney, Agent, or Firm*—Fliesler, Dubb, Meyer & Lovejoy LLP

[57] ABSTRACT

An improved automatic fill valve assembly that is readily securable in a level position for installation and that has inlets adapted to accept either a toilet tank fill valve or a float type valve inside of the housing of the fill valve assembly. One improvement comprises a flange that defines at least one anchor point so that the entire assembly can be secured in place to an adjacent structure during installation. This arrangement advantageously holds the automatic fill valve assembly in a level position while workers pour cement around it. Another improvement comprises the provision of inlets that can be connected to a water source and are adapted to mount either a float valve assembly or a toilet tank fill valve inside of the fill valve assembly.

16 Claims, 4 Drawing Sheets

AUTOMATIC FILL VALVE ASSEMBLY

BACKGROUND OF THE INVENTION

The invention relates generally to plumbing for swimming pools, spas and the like, and, more particularly, to automatic fill valve assemblies that automatically fill the pool or spa with water to automatically maintain a certain amount of water in the pool or spa.

Automatic fill valve assemblies that automatically fill the pool or spa with water to automatically maintain a certain amount of water in the pool or spa have become well known over the years. More particularly, a conventional fill valve assembly has a cylindrical housing with an internal chamber with a circular upper opening and having two water inlets. A first inlet is connected to a pipe coming from under the waterline of the pool. A second inlet is connected to a source of pressurized water, such as the fresh water supply system for a residence. An automatic valve actuated by a float is mounted inside the housing on this inlet so that the water in the pool or spa can be replenished as it evaporates, leaks from the pool or is otherwise diminished. A lid fits over the upper opening of the chamber formed in the housing.

While the above arrangement is generally effective, the automatic valve can be effected by the orientation of the fill valve assembly. In particular, if the fill valve assembly is not level, the automatic fill valve inside the assembly can malfunction and thus will not perform its function of maintaining the pool water at a desired level.

Further, the installation of the fill valve assembly is associated with several drawbacks. The fill valve assembly is installed when the pool or spa is under construction and is located so that its lid is flush with the deck or sidewalk adjacent to the edge of the pool. During the installation of the fill valve assembly, the ground adjacent to the pool is excavated to accommodate the deck around the pool, which can be constructed by pouring cement therein to form a concrete sidewalk. As the cement is poured, the fill valve assembly is manually held or otherwise jury-rigged on the ground in a level position at its desired location. One drawback associated with this method of installation is that the fill valve assembly can move when the cement is poured because the weight of the semi-liquid cement can dislodge the fill valve assembly. The plastic piping connecting the assembly to the pool is flexible and can move from force applied to the housing by the cement. Accordingly, the cement can harden and permanently secure the fill valve assembly in a position that is not level, which can cause the automatic valve in the assembly to malfunction. Further, a fill valve assembly held in a tilted position by hardened cement is not aesthetically appealing because its flat lid will not align with the flat sidewalk around it. Finally, even if the fill valve assembly is somehow level after the cement hardens, the process of jury-rigging the assembly in a level position is laborious and expensive.

It is known to mount two different types of automatic water valves in automatic fill valve assemblies for swimming pools: i) upright valves of the type commonly used to refill toilet tanks ("toilet tank fill valves") and ii) horizontally aligned float valve assemblies that have a float on a generally horizontal arm to actuate a water valve. In this regard, one drawback associated with the fill valve assembly described above is that it is configured only to mount a float valve assembly to the inlet connected to the water source. Accordingly, a contractor who has a toilet tank fill valve cannot install it in the automatic fill valve assembly and must endeavor to obtain a float type valve instead, resulting in wasted time and expense. Further, the fill valve assembly is typically installed by workers who are familiar with the installation of a fill valve assembly with such a float valve therein. Thus, workers who are not familiar with the installation of such a float valve and are instead familiar with toilet tank fill valves may encounter more difficulty during installation because of the different valve used within the fill valve assembly.

It should therefore be appreciated that there is a need for an automatic fill valve assembly that is readily securable in a level position for installation and that has inlets adapted to accept either a toilet tank fill valve or a float type valve inside of the housing of the fill valve assembly. The present invention fulfills this need.

SUMMARY OF THE INVENTION

Briefly, and in general terms, the present invention resides in an improved automatic fill valve assembly that is readily securable in a level position for installation and that has water inlets adapted to accept either an upright toilet tank fill valve or a generally horizontal float type valve inside of the housing of the fill valve assembly. One improvement comprises a flange that defines at least one anchor point so that the entire assembly can be secured in place to an adjacent structure during installation. This arrangement advantageously holds the automatic fill valve assembly in a level position while workers pour cement around it. Another improvement comprises the provision of second and third inlets that can be connected to a pressurized water source and are adapted to mount to a float valve assembly or a toilet tank fill valve inside of the fill valve assembly, respectively. This improvement advantageously allows the fill valve assembly to accommodate either type of valve, thereby making installation easier.

More specifically, the improvement includes apparatus and a method of installation of an automatic fill valve assembly for the plumbing system of a swimming pool or the like to maintain water therein at a predetermined level. The apparatus includes a structurally supportive housing having a sidewall, a first inlet for fluid communication with the water in the swimming pool and a second inlet for fluid communication with a pressurized water supply. Means is provided for mounting an automatic fill valve in the housing in fluid communication with the second inlet of the housing. A flange extends outwardly from the side wall of the housing and defines at least one anchor point for securing the housing in place to an adjacent structure during installation.

As described above, this flange and method of installation advantageously prevent the fill valve assembly from being moved by the heavy cement as it is poured around the housing. Thus, the method and apparatus of the invention ensure that the fill valve assembly remains level as the cement hardens, resulting in an easy and permanent installation of the assembly in a level orientation that is cosmetically appealing and that will not interfere with the operation of the valve inside of the assembly. In preferred embodiments of the invention, the anchor point comprises openings adapted to receive one or more ties for securing the housing in place to a reinforcing rod and the housing can have another flange with more anchor points thereon.

Another embodiment of the invention relates to the method of installing the fill valve assembly. This method includes excavating the ground adjacent to the swimming pool, determining a location on the excavated ground for the mounting of the automatic fill valve assembly and placing the housing of the fill valve assembly at that location. At least one support is then inserted into the ground adjacent to the flange located on the housing of the fill valve assembly and the support is fastened to the anchor point on the flange to secure the fill valve assembly in the predetermined location while a cementious substance is placed around the body of the fill valve assembly. The cementious substance subsequently hardens to permanently hold the fill valve assembly in the proper position. This method of installation shares the advantages identified above.

A final embodiment of the invention does not include the above flange but includes a third inlet for communication with a pressurized water supply. The second inlet is adapted to mount an automatic float valve assembly thereon and the third inlet is adapted to mount an automatic toilet tank fill valve thereon. Thus, this embodiment of the invention advantageously can accommodate either type of valve within the housing. This allows the installation worker to advantageously use the valve of his or her choice when installing the assembly. Further, installation is easier even if the worker is familiar with only one of the two types of valves that can be mount inside the fill valve assembly.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The following drawings illustrate the preferred embodiment of the invention. In such drawings.

DESCRIPTION OF THE PREFERRED EMBODIMENT

Figure 1:
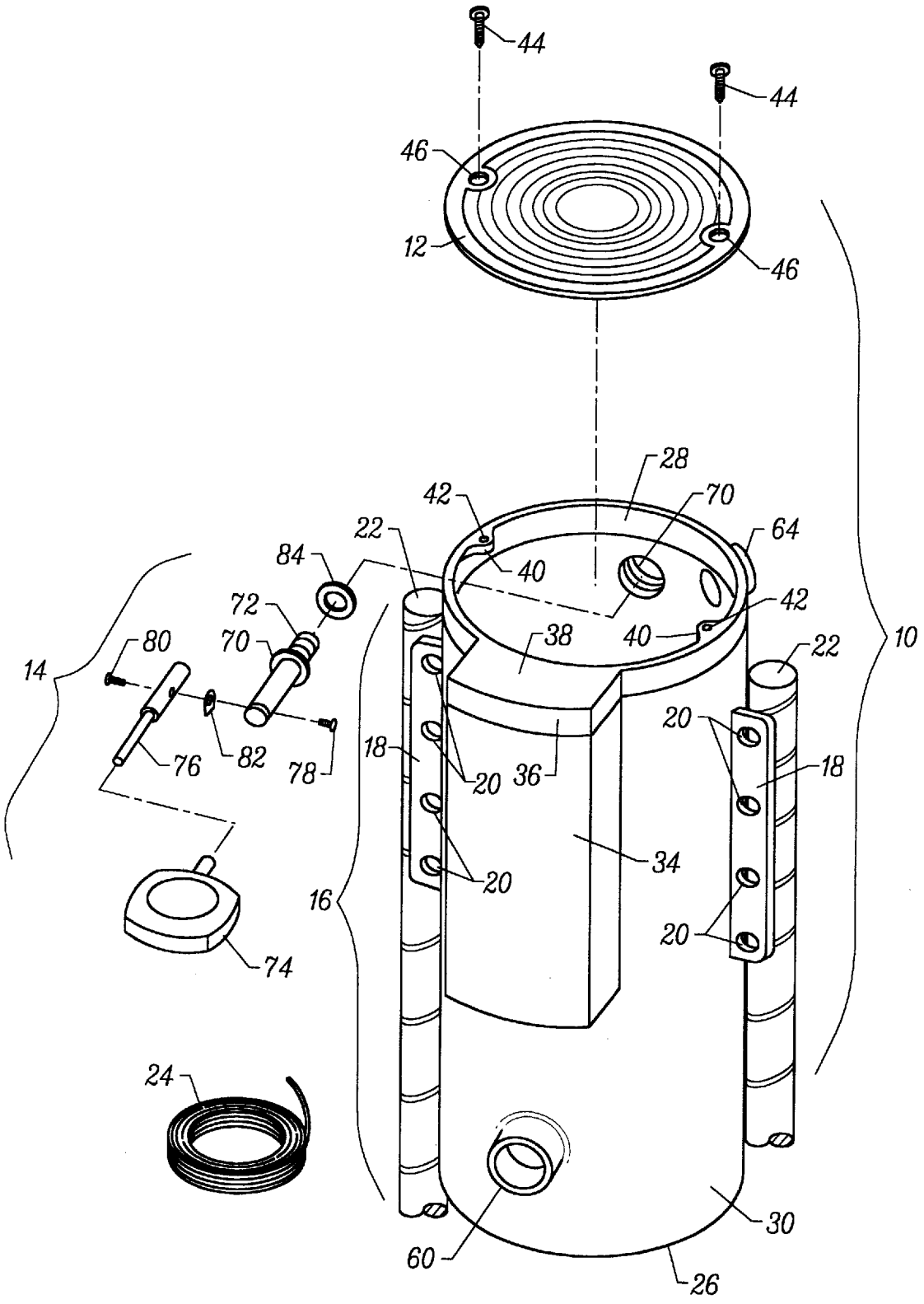
FIG. 1 is an exploded perspective view of a preferred automatic fill valve assembly and a float valve according to the invention.
Figure 3:
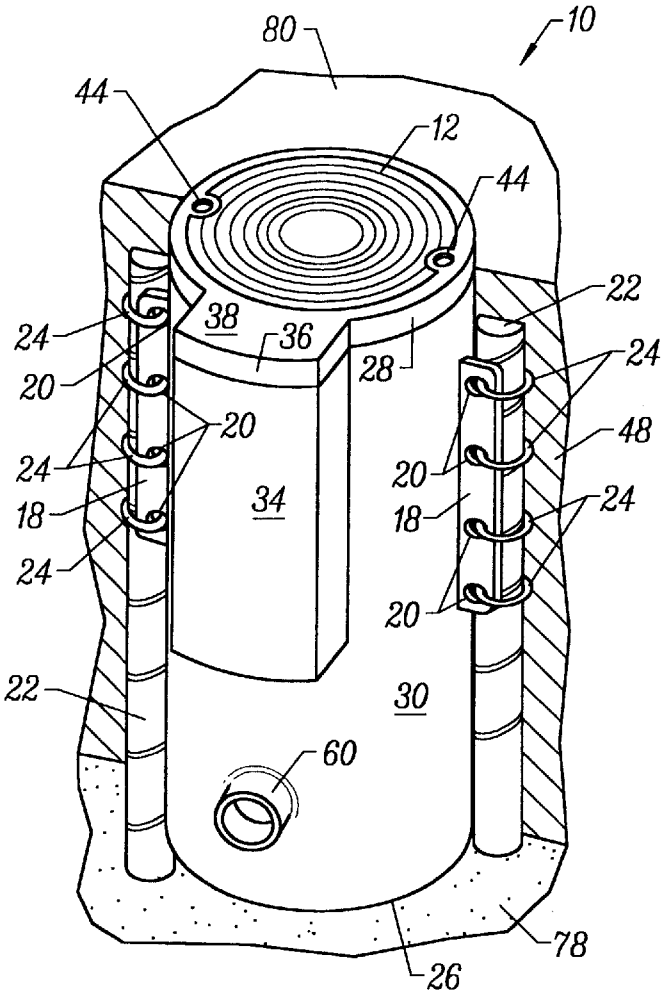
FIG. 3 is a perspective view, shown in partial cross section, of the automatic fill valve assembly of FIG. 1 installed in a cement sidewalk.
Figure 2:
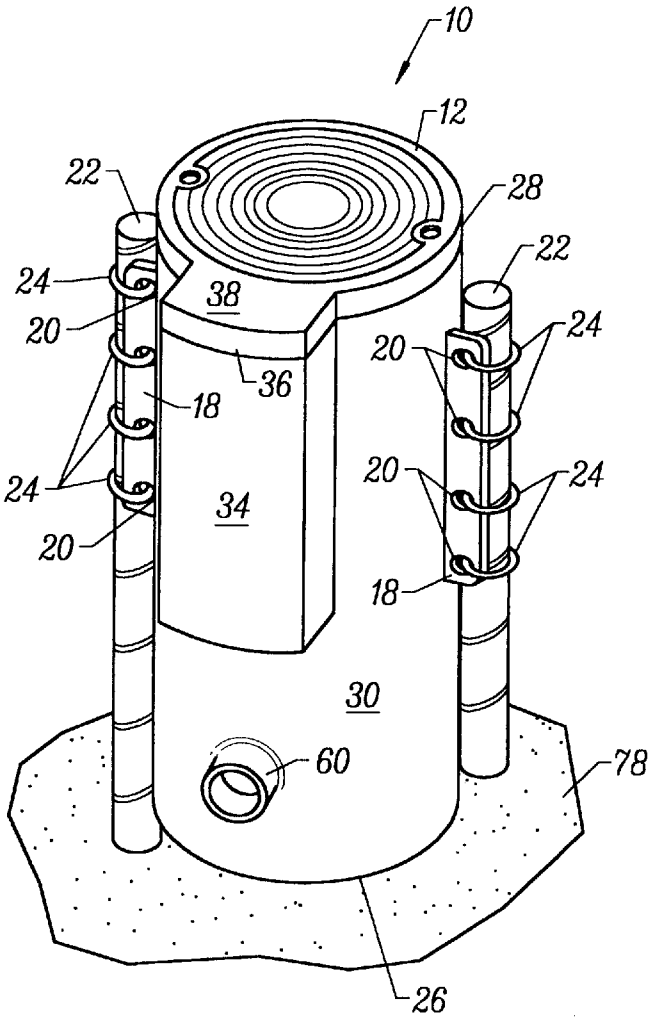
FIG. 2 is a perspective view of the preferred automatic fill valve assembly of FIG. 1 attached to two reinforcing rods mounted in the ground.
Figure 4:
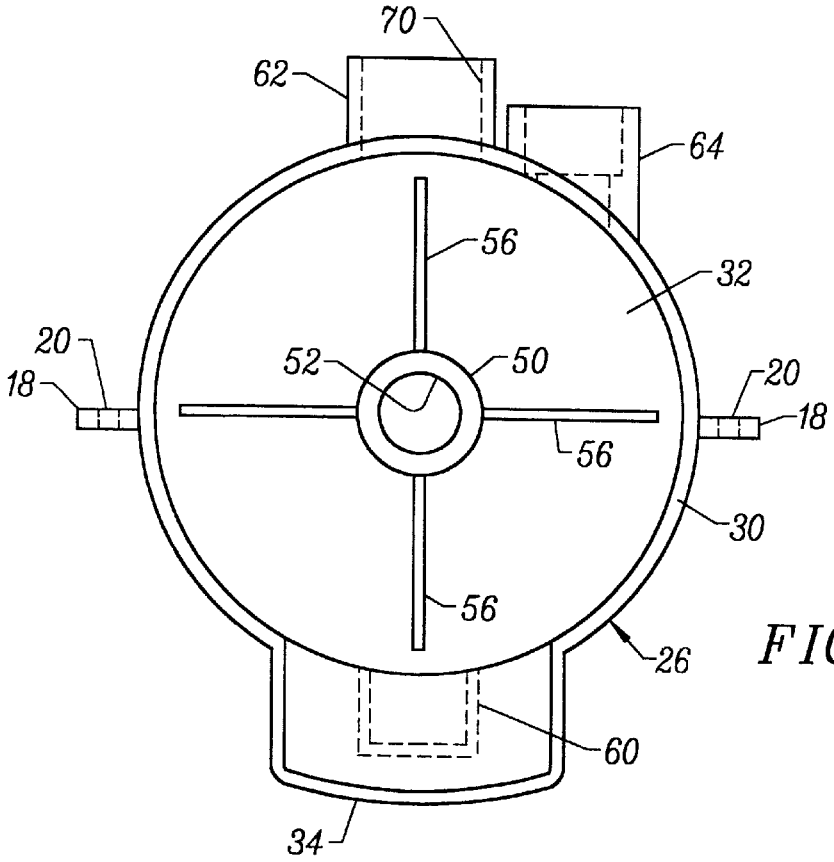
FIG. 4 is a top plan view of the automatic fill valve assembly of FIG. 1.

With reference now to the drawings, and particularly FIGS. 1 and 2, the present invention is preferably embodied in an automatic fill valve assembly, generally referred to by the reference numeral 10, for a swimming pool, spa or the like. The assembly 10 includes a flat circular lid 12, a horizontally oriented float type valve assembly 14, and a housing 16 that has two opposing flanges 18 with anchor points 20 defining openings thereon. The automatic fill valve assembly 10 is mounted to two structural supports 22, namely reinforcing rods commonly used to reinforce concrete structures, by wrapping wire ties 24 around the supports and the openings on the flanges so that the entire assembly 10 can be secured in place during installation. This arrangement advantageously holds the automatic fill valve assembly 10 in a level position while workers pour cement around it, resulting in a proper installation of the assembly 10.

As shown in FIGS. 1–5, the housing 16 is made of two separate components, a lower base 26 and an upper ring, 28 which can be mounted by suitable adhesive or mechanical fasteners to the top of the base 26. The base has a generally cylindrical side wall 30 surrounding a bottom wall 32 to form a chamber with an upper opening inside of the housing. The side wall of the base has a radially-enlarged projection 34 that aligns with a corresponding projection 36 on the ring, 26, which provides an upwardly facing surface 38 that can be used to mount a company logo or trademark adjacent to the lid 12. The lid is sized to cover the upper opening in the housing, which is formed by the ring, 26. The ring 26 has enlarged areas 40 with holes 42 formed therein to receive mounting screws 44 that pass through corresponding holes 46 in the lid to hold the lid over the upper opening of the housing of the fill valve assembly 10. The housing and the lid can be made of PVC plastic, ABS plastic or any other material of suitable strength and rigidity.

The flanges 18 are vertical and extend radially outwardly from the side wall at opposing sides of the base 28 of the housing 16. The anchor points 20 are vertically-aligned circular openings 20 in the flanges to allow the wire ties 24 to wrap the flanges to the support rods 22. In this regard, it should be appreciated that the spirit and scope of the invention includes anchor points of any configuration, including cleats, tabs, slots, clips or projections or indentations that a tie or fastener can be secured to. In this same regard, it should be appreciated that the ties can be any type of fastener, including nylon strips, nails, nuts and bolts or clamps. The ties can be made of any suitable flexible or rigid material, including string, nylon, galvanized steel. Because the flanges of the fill valve assembly 10 can easily be secured to the support rods 22, the fill valve assembly 10 will be level as the cement 48 hardens and will be easily and permanently installed in a level orientation that is cosmetically appealing and that will not interfere with the operation of the float valve 14 inside of the assembly 10.

Figure 6:
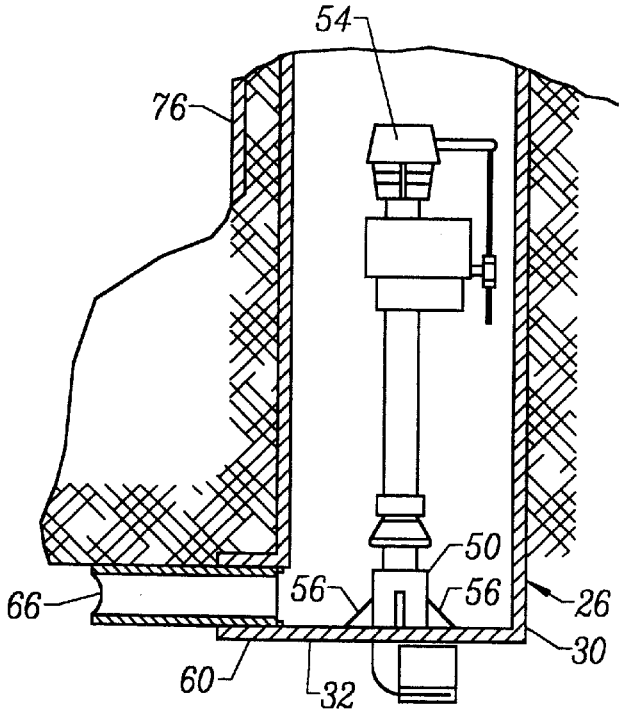
FIG. 6 is a cross-sectional view of the automatic fill valve assembly of FIG. 1, with a toilet tank fill valve installed therein instead of the float valve.
Figure 5:
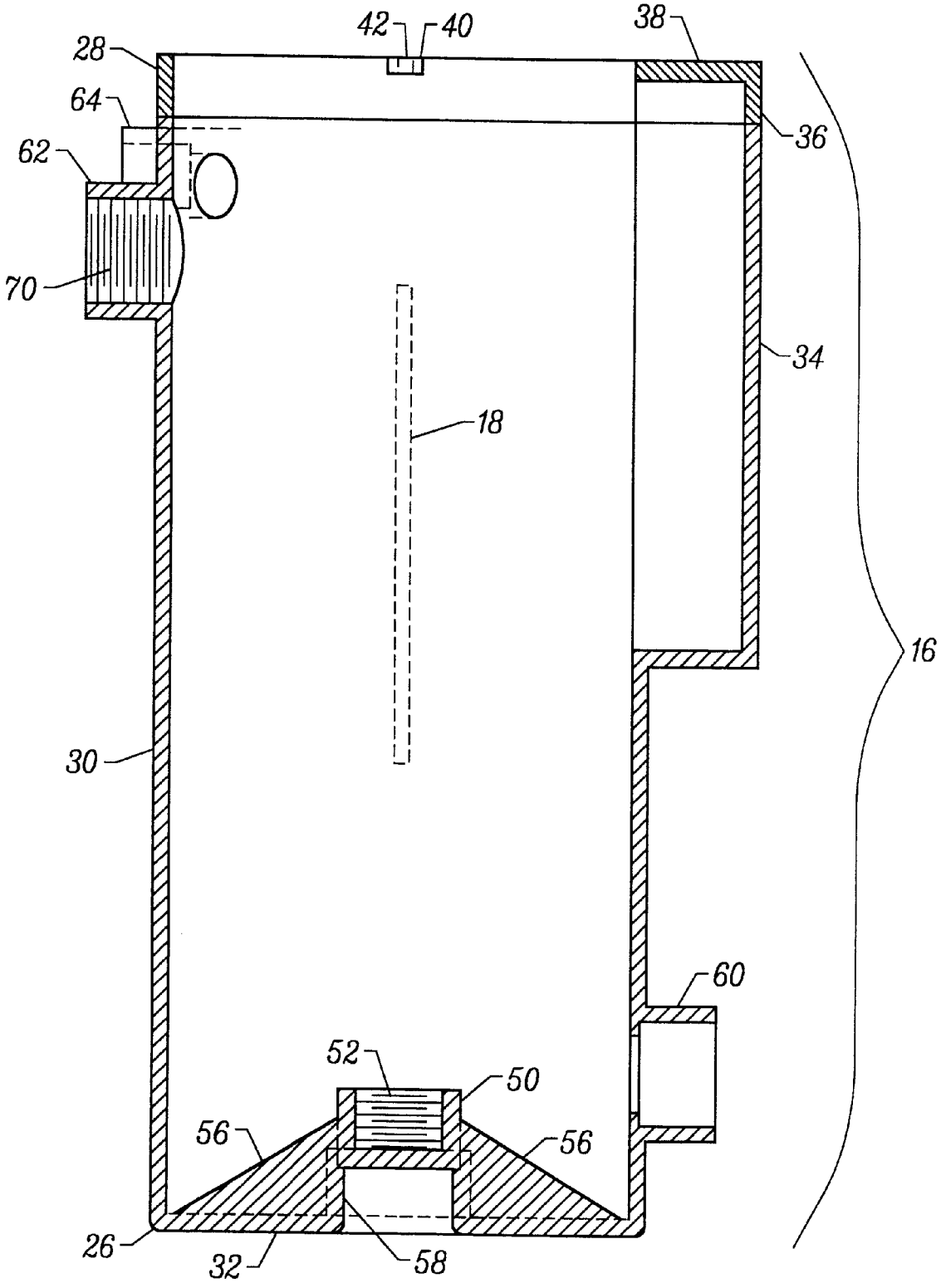
FIG. 5 is a cross-sectional view of the housing of the automatic fill valve assembly of FIG. 1.

The base of the housing has three inlets 50, 60 and 62 and one overflow outlet 64 for water to flow into and out of the automatic fill valve housing 16. As shown in FIGS. 5 and 6, the bottom wall 32 of the base 26 has one cylindrical inlet 50 formed therein. This inlet 50 has internal threads 52 sized to accept the base of a commonly available toilet tank fill valve 54, like those commonly found in residential toilets. Four support walls 56 extend radially outward from the inlet to the bottom wall 32 of the base 26. The bottom 58 of the inlet 50 is sized to accept a PVC pipe connected to a pressurized water source. Such a pipe can be mounted in the inlet by the use of adhesive or other fasteners, as is well known in the art.

Another inlet 60 for pool water is formed in the lower portion of the side wall 30 of the base 26 of the housing 16. This inlet 60 can be connected in the above manner to a pipe 66 leading to the body of water in the pool or spa. Because the pool water inlet 60 provides for unrestricted fluid communication between the housing 16 and the body of water in the pool, the water level in the housing will equal that of the pool and water added to the housing will flow into the pool.

The remaining inlet 62 is located higher up the side wall 30 of the base 26 of the housing 16, just under the level of the overflow outlet 64. The external portion 68 of the inlet 62 can be connected to a pipe leading to a pressurized water source. The inlet 62 has internal threads 70 sized to mount to the float valve 14, which has a body 70 with external threads 72 thereon. The outlet 64 is located above this inlet 62 so that an optional drain pipe can be connected to the housing 16. When such a drain pipe is connected, the water level of the housing and the pool will be drained if it reaches the level of the overflow outlet. This can prevent the pool from overflowing if the automatic valve 14 in the housing 16 fails and continuously allows water to flow into the pool. If the design of the pool does not allow for an overflow drain, then the overflow outlet can be plugged by a threaded plug (not shown).

The float valve assembly 14 has a float 74 mounted to one end of an arm 76, or stem, that actuates a valve in the body 70. Two screws 78 and 80 and a clip 82 mount the arm 76 to the valve body 70. The screw 78 that is nearest to the valve body fastens the clip 82 to the valve body 70. The screw 80 adjacent to the arm adjustably fastens the arm 76 to the clip 82 so that the angle of the arm can be adjusted to activate the valve at a particular water level, as is well known in the art. As the water level of the pool goes down, the water level inside the housing 16 is correspondingly reduced and the float 74 will travel downward until the valve is activated to allow water from the water supply to enter the housing and travel into the pool. As shown in FIG. 6, a common toilet tank fill valve 54 can be used instead of the float valve. Regardless of the type of valve is used, the automatic fill valve assembly 10 will automatically replenish water lost from the pool by evaporation, leakage or the like. Thus, the automatic fill valve assembly automatically maintains the water level of the pool.

An improvement associated with the automatic fill valve assembly 10 is that it has two inlets 50 and 62 for the mounting of automatic fill valves of generally horizontal and upright orientations, respectively. Thus, these inlets can be connected to a water source and are adapted to mount to a float valve assembly 14 or a toilet tank fill valve 54 inside of the fill valve assembly 10. This improvement advantageously allows the fill valve assembly to accommodate either type of valve, thereby making installation more convenient and less expensive.

The method of installing the automatic fill valve assembly 10 will now be described with reference to FIGS. 1–3 and 6. First, the worker determines the location where the assembly 10 should be installed, which can be adjacent to the edge of a swimming pool 76. Because most of the assembly is recessed, the worker must excavate the ground 78 in the desired area to a depth sufficient to align the lid 12 with the surface of the sidewalk 80 adjacent to the assembly. Once the excavation is complete, the joined base 26 and ring 28 of the housing 16 are positioned so that the lid 12 of the assembly 10 will be level and flush with the surface of the sidewalk 80 adjacent to the assembly 10. It should be noted that, according to well known methods, the piping leading to the assembly is also installed at this time. This installation includes the pipe 66 from the body of the housing to the pool water body, the overflow pipe leading to a drain, and the connection of a pressurized water supply pipe to the inlet 50 or 62 where the desired fill valve 54 or 14 will be mounted.

Next, reinforcing rods 22 that are commonly used to reinforce concrete structures are pounded into the ground 78 adjacent to the flanges 18 of the housing 16. Once the rods 22 are inserted into the ground 78, wire ties 24 are inserted through the hole-shaped anchor points 20 on the flanges of the housing and wrapped around the adjacent rod 22 and back through the holes until the whole fill valve assembly 10 is securely fastened to the support rods 22 (FIG.2). Subsequently, semi-liquid cement 48 is poured around the secured assembly 10, which does not move out of position under the pressure from the heavy cement, thereby advantageously ensuring that the finished, permanent installation of the fill valve assembly 10 is level and that its lid is flush with the surface 80 of the hardened cement. The float valve 14 or the toilet tank fill valve 54 can then be installed and the lid 12 can be attached to the housing 16 with the mounting screws 44. This method of securing the assembly 10 is very convenient, resulting in reduced labor costs for installation and a high quality final installation.

While a particular form of the invention has been illustrated and described, it will be apparent that various modifications can be made without departing from the spirit and scope of the invention. Accordingly, it is not intended that the invention be limited, except as by the appended claims.

We claim:

1. An automatic fill valve assembly for mounting in the plumbing system of a swimming pool to maintain water therein at a predetermined level, comprising:

a housing having a sidewall, the housing having a first inlet for fluid communication with the water in the swimming pool and a second inlet for fluid communication with a pressurized water supply;

means for mounting an automatic fill valve in the housing in fluid communication with the second inlet; and an integrated flange having a planar surface extending outwardly from the side wall of the housing to an edge, the flange defining at least one anchor point in the plane for securing the housing in place to an adjacent structure during installation.

2. The automatic fill valve assembly of claim 1, wherein the anchor point comprises openings adapted to receive one or more ties for securing the housing in place.

3. The automatic fill valve assembly of claim 2, wherein the anchor point defines four vertically spaced holes.

4. The automatic fill valve assembly of claim 2, further comprising another integrated flange extending outwardly from the external surface of the side wall, the additional flange also defining at least one anchor point for securing the housing in place to an adjacent structure during installation.

5. The automatic fill valve assembly of claim 4, wherein the flanges are located on opposite sides of the housing.

6. The automatic fill valve assembly of claim 1, wherein the housing also has a third fluid inlet, and the fill valve assembly further comprises means for mounting a second automatic fill valve inside the chamber of the body in fluid communication with the third fluid inlet.

7. An automatic fill valve assembly for mounting in the plumbing system of a swimming pool to maintain water therein at a predetermined level, comprising:

a tubular, structurally supportive housing having a side wall and a bottom wall, the bottom wall joined at its periphery by the side wall to define an internal chamber with an upper opening, the housing having a first inlet for fluid communication with the water in the swimming pool, a second inlet for fluid communication with a water supply, and a third inlet for communication with a water supply, the housing further including a flange having a planar surface oriented generally normal to the sidewall and extending outwardly therefrom to an edge; and wherein the second inlet is adapted to mount an automatic float valve assembly thereon in the internal chamber of the housing in fluid communication with the water source and the third inlet is adapted to mount an automatic toilet tank fill valve thereon in the internal chamber of the housing in fluid communication with the water source.

8. The automatic fill valve assembly of claim 7, further comprising a flange extending outwardly from the side wall of the housing, the flange defining at least one anchor point between the sidewall and the edge for securing the housing in place to an adjacent structure during installation.

9. The automatic fill valve assembly of claim 7, wherein the second inlet has internal threads sized to mate with the float valve assembly.

10. The automatic fill valve assembly of claim 9, wherein the third inlet has internal threads sized to mate with the toilet tank fill valve.

11. The automatic fill valve assembly of claim 7, wherein the third inlet has internal threads sized to mate with the toilet tank fill valve.

12. A method of installing an automatic fill valve assembly in the plumbing system of a swimming pool to maintain water therein at a predetermined level, the automatic fill valve assembly having a structurally supportive housing having a sidewall, the housing having a first inlet for fluid communication with the water in the swimming pool and a second inlet for fluid communication with a water supply, the housing further including means for mounting an automatic fill valve in the housing in fluid communication with the second inlet and a flange extending outwardly from the side wall of the housing, the flange defining at least one anchor point for securing the housing in place to an adjacent structure during installation, the method comprising:

excavating the ground adjacent to the swimming pool;

determining a location on the excavated ground adjacent to the swimming pool for the mounting of the automatic fill valve assembly;

placing the housing of the fill valve assembly at the location;

inserting at least one support into the ground adjacent to the flange located on the housing of the fill valve assembly; and fastening the support to the anchor point on the flange of the housing of the fill valve assembly to secure the fill valve assembly in the predetermined location while a cementious substance is placed around the body of the fill valve assembly and subsequently hardens to permanently hold the fill valve assembly.

13. The method of installing an automatic fill valve assembly as set forth in claim 12, wherein the support is a steel reinforcing rod and the fastening of the support comprises wrapping wire around the rod and the anchor point on the housing.

14. The method of installing an automatic fill valve assembly as set forth in claim 13, wherein two reinforcing rods are inserted into the ground adjacent to the flange on the housing of the fill valve assembly.

15. The method of installing an automatic fill valve assembly as set forth in claim 14, wherein the anchor point comprises openings adapted to receive one or more ties for securing the housing in place.

16. The method of installing an automatic fill valve assembly as set forth in claim 12, wherein the anchor point comprises openings adapted to receive one or more ties for securing the housing in place.

* * * * *